US005540329A

United States Patent [19]

Vogeley

[11] Patent Number: 5,540,329

[45] Date of Patent: Jul. 30, 1996

[54] BUCKET-INSERTED HARDWARE ORGANIZER

[76] Inventor: Chris J. Vogeley, 350 RiverBend Pkwy., Athens, Ga. 30605

[21] Appl. No.: 495,381

[22] Filed: Jun. 28, 1995

[51] Int. Cl.[6] ..... B65D 25/06

[52] U.S. Cl. ..... 206/373; 206/459.5; 206/499; 206/509; 220/532; 211/70.6

[58] Field of Search ..... 206/373, 499, 206/459.5, 338, 509, 510; 211/70.6; 220/532, 533, 771, 773

[56] References Cited

U.S. PATENT DOCUMENTS

| | | | |
|---|---|---|---|
| 4,362,243 | 12/1982 | Deyesso et al. | 206/373 |
| 4,826,007 | 5/1989 | Skeie | 206/373 |
| 4,867,332 | 9/1989 | Mains | 220/85 |
| 4,925,026 | 5/1990 | McKay | 206/373 |
| 5,083,664 | 2/1992 | Feng | 211/70.6 |
| 5,086,917 | 2/1992 | Dziersk | 206/510 |
| 5,186,329 | 2/1993 | Fogelberg | 206/372 |
| 5,255,816 | 10/1993 | Trepp | 206/338 |
| 5,261,556 | 11/1993 | Gatto | 220/529 |
| 5,350,065 | 9/1994 | Darrey | 206/373 |
| 5,415,277 | 5/1995 | Berntsen | 206/510 |

*Primary Examiner*—Paul T. Sewell
*Assistant Examiner*—Luan K. Bui
*Attorney, Agent, or Firm*—Charles B. Katz

[57] ABSTRACT

A device is disclosed for use in organizing, storing and transporting hardware and other small items. The device comprises a plurality of identically constructed circular trays designed to be vertically stacked within the interior volume of a standard-sized bucket. Each tray is provided with a plurality of radial partitions which divide the tray into separate compartments suitable for the organized storage of groups of like items. The trays are further provided with a handle for grasping and lifting the trays. The underside of the tray floors are adapted with a cylindrical recess allowing the handle of the inferior tray to nest within the recess disposed in the floor of the superior tray when the trays are stacked within the bucket.

8 Claims, 4 Drawing Sheets

BUCKET-INSERTED HARDWARE ORGANIZER

FIELD OF THE INVENTION

The invention relates to a device for storing, organizing and transporting hardware and related objects, and more particularly to a storage device designed to be inserted into a standard-sized bucket or pail.

BACKGROUND OF THE INVENTION

People engaged in construction or repair work frequently have need for a lightweight and inexpensive device for storing and transporting hardware, such as nuts, bolts and screws, as well as other small items or accessories. Many tradespersons utilize empty five-gallon buckets, of the type originally used as containers for paint or drywall compound, for this purpose. These buckets are generally constructed of plastic and are adapted with handles or a wire bail for transporting the buckets around the job site. In addition, the buckets are sturdy, waterproof, and readily available at little or no cost after being discarded by the user of their original contents.

However, an undivided bucket is not well-suited to storing a variety of hardware or other small items in an organized fashion. In order to work efficiently, the worker must be able to easily and rapidly locate and retrieve the desired item from the bucket. It is therefore preferable that the bucket be divided into separate compartments such that items of the same type, such as nuts or bolts of a particular size or specification, be stored within the same compartment.

The prior art includes numerous devices intended to adapt empty five gallon buckets for use in storing and transporting articles on the job site. For the most part, these devices have been primarily concerned withholding and organizing handtools, such as hammers, screwdrivers, chisels and the like, rather than hardware or small items. U.S. Pat. Nos. 5,350,065; 5,186,329; 4,867,332, and; 4,362,243 disclose devices intended to be inserted into the bucket and which provide partitions or holes for holding and organizing handtools.

Some prior art devices, while being principally directed towards the storage of handtools, additionally provide compartments or other means intended to hold hardware or other small items. For example, U.S. Pat. No. 5,350,065, issued to Darrey, discloses a bucket insert comprising a planar annular top positioned at the top of the bucket and a cylindrical cavity extending downward through the interior of the bucket. The annular top is adapted with an array of holes for receiving hand tools. The undivided inner cylindrical volume is designed to hold nuts, screws and the like. However, this device does not provide multiple compartments or volumes for organizing different types of hardware.

More elaborate approaches to organizing and storing small items within a bucket-inserted device are disclosed in U.S. Pat. No. 5,261,556, issued to Gatto; U.S. Pat. No. 4,925,026, issued to McKay, and; U.S. Pat. No. 4,826,007, issued to Skeie. Gatto teaches a bucket insert having radial members for dividing the bucket interior into a plurality (typically four) of separate storage areas. Storage and organization assemblies, comprising storage elements such as tool organizers or hardware storage compartments, nest within the storage areas and may be extracted from the bucket as required. McKay teaches an insert having a system of spiral springs for engaging and holding tools in a vertical orientation and which is further provided with a cabinet mounted on the wall component of the insert, the cabinet having a plurality of drawers for organizing and storing small items such as screws or nuts. Finally, Skeie teaches an adaptation for a bucket comprising a large base member adapted with a plurality of compartments for holding small objects, and an annular ring member including a plurality of slots and holes intended to receive and hold handtools.

What does not appear in the prior art is a simple and inexpensively-manufactured device which provides a sufficient number of compartments specifically intended for organizing and storing the wide array of hardware, tool accessories and other small items needed by tradespersons at a job site or by homeowners performing repair work. The objects stored in such a device may include various sizes of nuts, bolts, nails and drywall screws; Sawzall® and jigsaw blades; router and drill bits of different sizes and specifications; plumbing firings; staples, and; nail punches or other small tools.

It is therefore an object of the present invention to provide a device which fits within the interior of a standard five gallon bucket and which includes a plurality of separate compartments for storing and organizing groups of hardware and related objects.

A more specific object of the invention is to provide such a device which facilitates rapid access to the objects stored within.

Another object of the invention is to provide such a device which may be manufactured and sold inexpensively.

Yet another object of the invention is to provide such a device in which the number and size of storage compartments may be adjusted to suit the individual user's needs.

These and other objects of the invention will be apparent to those skilled in the art from the following derailed description of a preferred embodiment of the invention.

SUMMARY OF THE INVENTION

The device comprises a plurality of identical circular trays each adapted with a set of compartments or bins for organizing and storing groups of hardware items. The trays are designed to be stacked vertically within the bucket interior, with the inferior-most tray resting on the floor of the bucket. In the preferred embodiment of the invention, each tray will include between two and six separate storage compartments, and up to three trays may be stacked within the bucket.

Each tray further comprises a tray floor, a vertical circumferential tray sidewall extending upward from the tray floor, a central hub member and a plurality of radial partitions extending from the circumference of the hub member to the sidewall. The compartments in which the hardware items are stored are defined by the respective surfaces of the tray floor, sidewall, radial partitions and hub member. In the preferred embodiment of the invention, one or more of the radial partitions are removable, allowing the user to adjust the number of compartments according to the user's requirements.

Each tray is further provided with a handle to facilitate grasping the tray and manually lifting the tray from the bucket interior, thereby allowing access to items stored in the inferior tray. The handle preferably comprises a centrally disposed inverted U-shaped member attached to or formed integrally with the top edges of opposed radial partitions.

In order to permit vertical stacking of the trays, a concave recess is provided in the central portion of the tray floor. The upper portion of the handle of the inferior tray may then nest within the interior of the concave recess disposed in the superior tray floor.

DETAILED DESCRIPTION OF THE INVENTION

Figure 1:
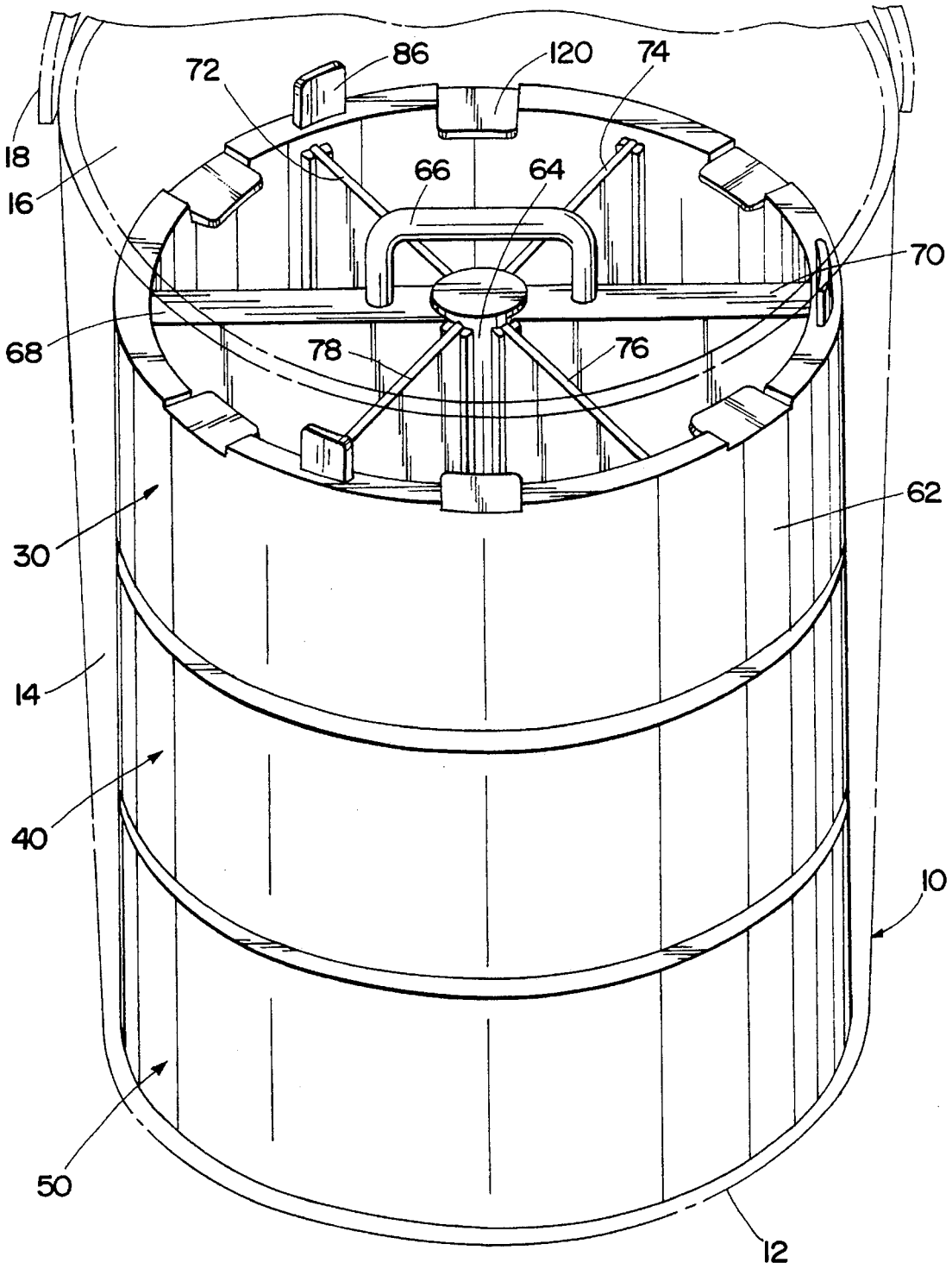
FIG. 1 is a perspective view of the invention showing some of the major features thereof.

The present invention is intended to be utilized in conjunction with an empty standard five-gallon bucket, such as that which is used as a container for spackling or drywall taping compound or paint. Referring to FIG. 1, the bucket, generally referred to as 10, is seen to comprise solid circular floor 12, vertical sidewall 14 and open top 16. The bucket is typically of inverted frustro-conical shape, the bucket sidewall tapering outwardly from a bottom diameter of approximately 10¼" a top diameter of approximately 11¼". The vertical dimension of the sidewall is approximately 14". To assist the user in transporting the bucket, it is provided with generally semicircular wire bail 18 pivotally attached to the upper margins of the sidewalls at diametrically opposed points. The wire bail may be adapted with a handle disposed at or proximal to the apex of the bail. The bucket may additionally be provided with a planar circular cover including means for engaging the upper rim of the bucket sidewall. The cover serves to prevent spillage of the bucket's contents and to keep the contents dry in inclement weather.

The essence of the invention consists of identically constructed storage trays 30, 40 and 50, the trays being designed to be completely received within the interior of bucket 10 in a vertically stacked arrangement. It is contemplated that three trays will normally be employed, although two trays or even a single tray may be used if only limited storage volume is needed by the user. As seen in FIG. 1, inferiormost tray 50 rests upon bucket floor 12, while middle tray 40 is stacked on top of tray 50 and uppermost tray 30 is stacked on top of middle tray 40.

Figure 2:
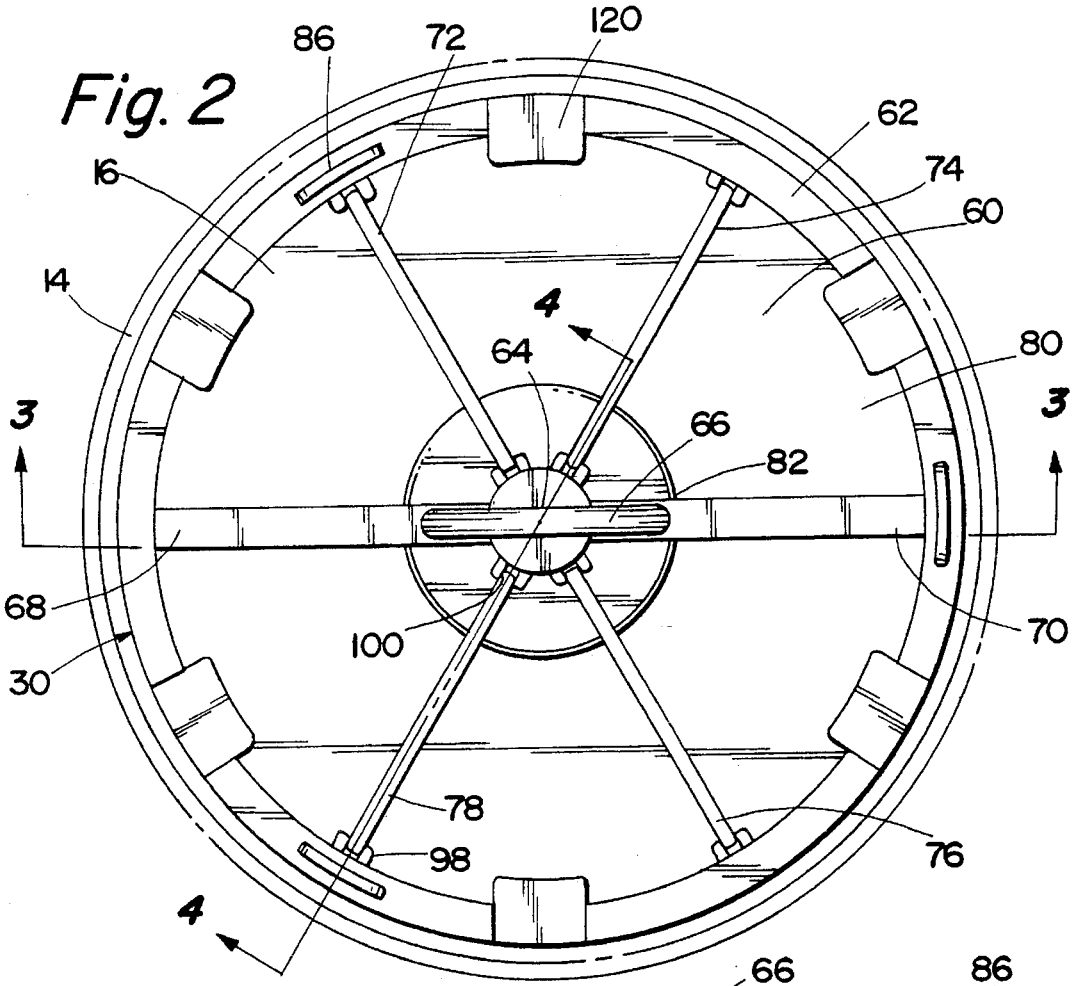
FIG. 2 is a top plan view of the invention.
Figure 3:
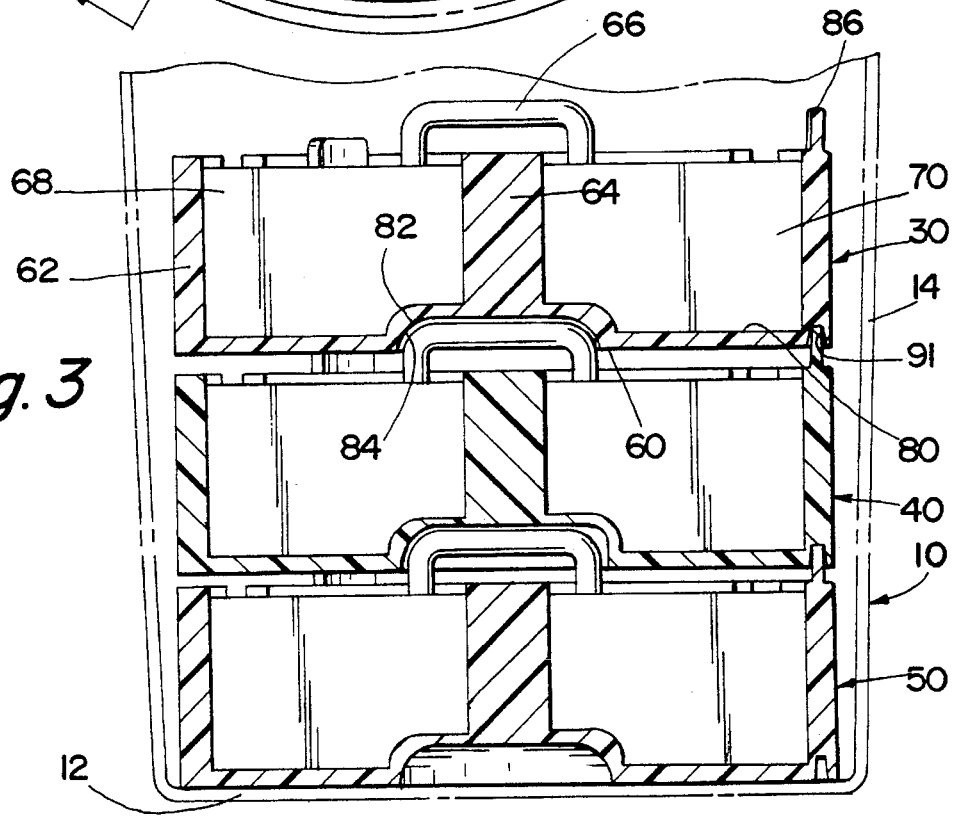
FIG. 3 is a vertical cross-sectional view of the invention taken along line 3—3 of FIG. 2.

Making reference now to FIGS. 2 and 3, tray 30 (shown as an example, noting that all trays are of identical construction) can be seen to generally comprise tray floor 60, circumferential sidewall 62, hub member 64, handle 66, fixed radial partitions 68 and 70, and removable radial partitions 72, 74, 76 and 78. The tray floor typically has a diameter of 10", the diameter being chosen to permit seating of the tray within the bucket without excessive clearance between the outer surface of the tray sidewall and the inner surface of the bucket sidewall. Referring to FIG. 3, it is noted that the tray floor comprises generally planar outer region 80 and concave inner region 82. The underside of the concave inner region defines generally cylindrical recess 84 which receives the upwardly projecting handle of the inferior tray, thereby permitting the trays to be stacked without interference between the handle of the inferior tray and the tray floor of the superior tray.

Referring to FIG. 3, vertical sidewall 62 is permanently joined to or formed integrally with the tray floor around the circumference thereof. In the preferred embodiment of the invention, the sidewall will have a height of about 3½, which allows a maximum of three trays to be stacked within the standard five-gallon bucket. Of course, the height of the sidewall may be decreased if it is desired that additional trays be accommodated within the bucket. Conversely, trays with a substantially greater sidewall height may be used if only one or two trays need be accommodated by the bucket.

Figure 6:
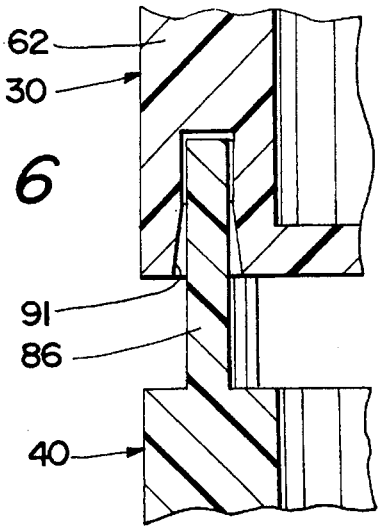
FIG. 6 is a fragmentary view showing in detail the cooperative arrangement of tabs and slots of vertical stacked trays.

Making reference to FIGS. 2 and 3, the sidewall may include a plurality of tabs 86 disposed on and projecting upwardly from the sidewall upper rim in cooperative arrangement with a corresponding plurality of slots 91 disposed in the lower margins of the sidewall of the superior tray. The tab and slot arrangement permits the trays to be aligned in a predetermined manner and prevent horizontal slippage of superior trays within the bucket. In the preferred embodiment, the tabs are generally rectangular in shape, having a width of approximately ⅝", a height of approximately 1", and a depth of approximately 3/16". Making reference to FIG. 6, the slots are adapted with a downwardly and outwardly flaring lower portion which serves to guide the upper portion of the corresponding tab into the slot. It is observed that the height of the slot is sized such that only the top ½" of the tab is received within the slot, thereby producing a vertical offset of approximately ½" between the sidewall rim of the inferior tray and the floor of the superior tray.

Making reference again to FIG. 3, the tray further comprises cylindrical hub member 64. The hub member is disposed in the center of the tray and is permanently joined to or formed integrally with tray floor 60. The hub member typically will have a diameter of approximately 1" and a height of about 3", with the top surface of the hub member being substantially co-planar with the tray sidewall rim.

Because of the vertically stacked arrangement of the trays within the bucket, it will frequently be necessary for the user lo remove trays from the bucket in order to gain access to items held in an inferior tray. Therefore, each tray is adapted with a handle to facilitate manual grasping and lifting thereof. Referring to FIGS. 2 and 3, handle 66 comprises an inverted U-shaped member attached at its ends to the upper edges of opposed fixed dividers 68 and 70. In the preferred embodiment of the invention, the handle has an inner width of approximately 1½" and will project approximately 1½–2" above the plane described by the rim of the sidewall. As discussed above, the upper portion of the handle is designed to be received within the cylindrical recess; formed in the underside of the superior tray floor when the trays are stacked vertically within the bucket. It is noted that a T-shaped or flanged handle may be substituted without departing from the essence of the invention.

Making reference again to FIGS. 2 and 3, the tray is divided into six separate compartments by the radial partitions, each of the partitions extending radially outward from the central hub member to the inner surface of the tray sidewall. The compartments are bounded by the facing surfaces of adjacent radial partitions, the upper surface of the tray floor, the inner surface of the tray sidewall and the hub member. It should be noted that although the preferred embodiment of the invention, as depicted in the figures, provides for a maximum of six compartments, alternative embodiments of the invention may provide fewer or more compartments without departing from the essence of the invention.

One of the objectives of the present invention is to provide a device for storing hardware and related items in which the number and size of the compartments may be adjusted by the user according to his or her requirements. This objective is accomplished by the use of removable radial partitions. With all of the partitions inserted, as depicted in FIG. 2, the tray is divided into six compartments of approximately equal capacity. By removing partitions from the tray, the user may create compartments of greater capacity. For example, the user may configure the tray into one large generally semi-circular compartment and three smaller compartments by removing two adjacent radial partitions.

Figure 4:
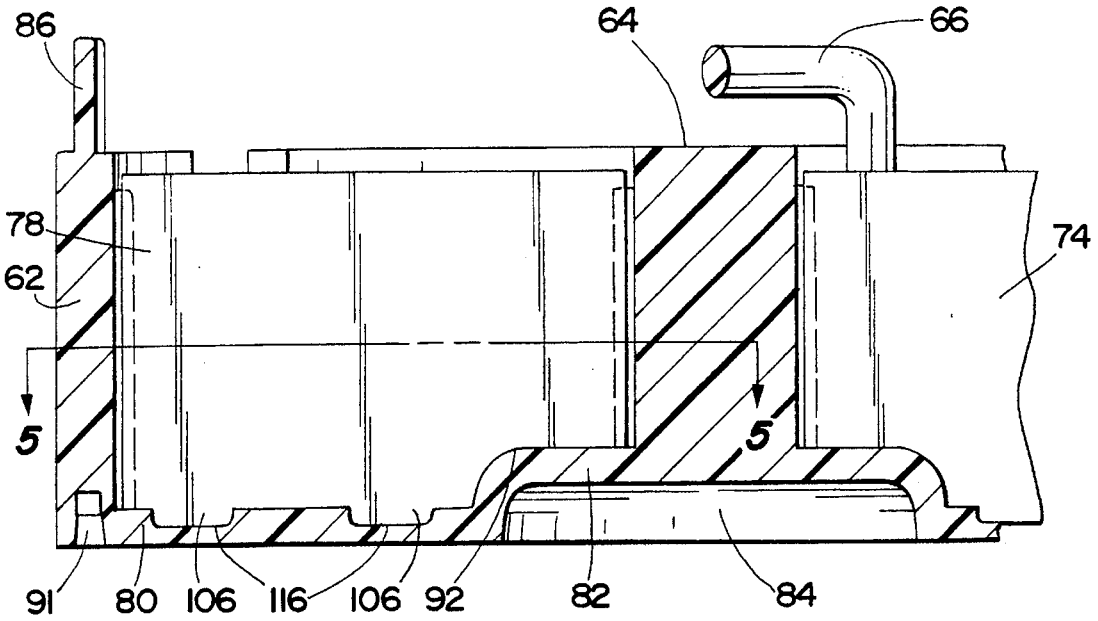
FIG. 4 is another vertical cross-sectional view of the invention, the view taken along line 4—4 of FIG. 2 and depicting in particular the removable radial partition.
Figure 5:
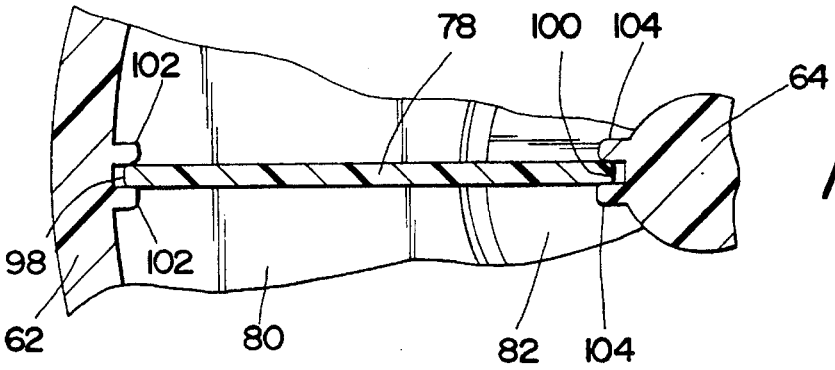
FIG. 5 is a cross-sectional view of the partition, tray floor and sidewall taken along line 5—5 of FIG. 4.

Referring to FIGS. 4 and 5, removable radial partition 78, shown as an example, is seen to comprise a generally rectangular planar member having recessed cutout region 92 which conforms to the upper surface of the concave portion of tray floor. The vertical edges of the partition are received within grooves 98 and 100 formed by rail pairs 102 and 104, thereby holding the partition in place within the tray. The partition is further secured by tabs 106, which project downwards from the partition lower edge and engage corresponding slots 116 formed in the tray floor. To remove the partition from the tray, the partition is grasped by the user and pulled upwards, calming the partition vertical edges to be slid up through the grooves until the partition is pulled free from the tray. To replace the partition, the vertical edges are aligned with the grooves and the partition pushed downwards until the lower edge contacts the floor member and the slob and tabs are engaged.

As depicted in FIG. 2, the invention may include a plurality of label-retaining members 120 corresponding to the tray compartments, the label-retaining members each being generally rectangular and joined along its outer edge to the inner surface of tray sidewall 62 at the upper margin thereof. The label-retaining members each provide a horizontal surface on top of which a label identifying the contents of the corresponding compartment may be affixed. This will allow the user to rapidly and easily locate the required item and retrieve said item from the tray.

Figure 7:
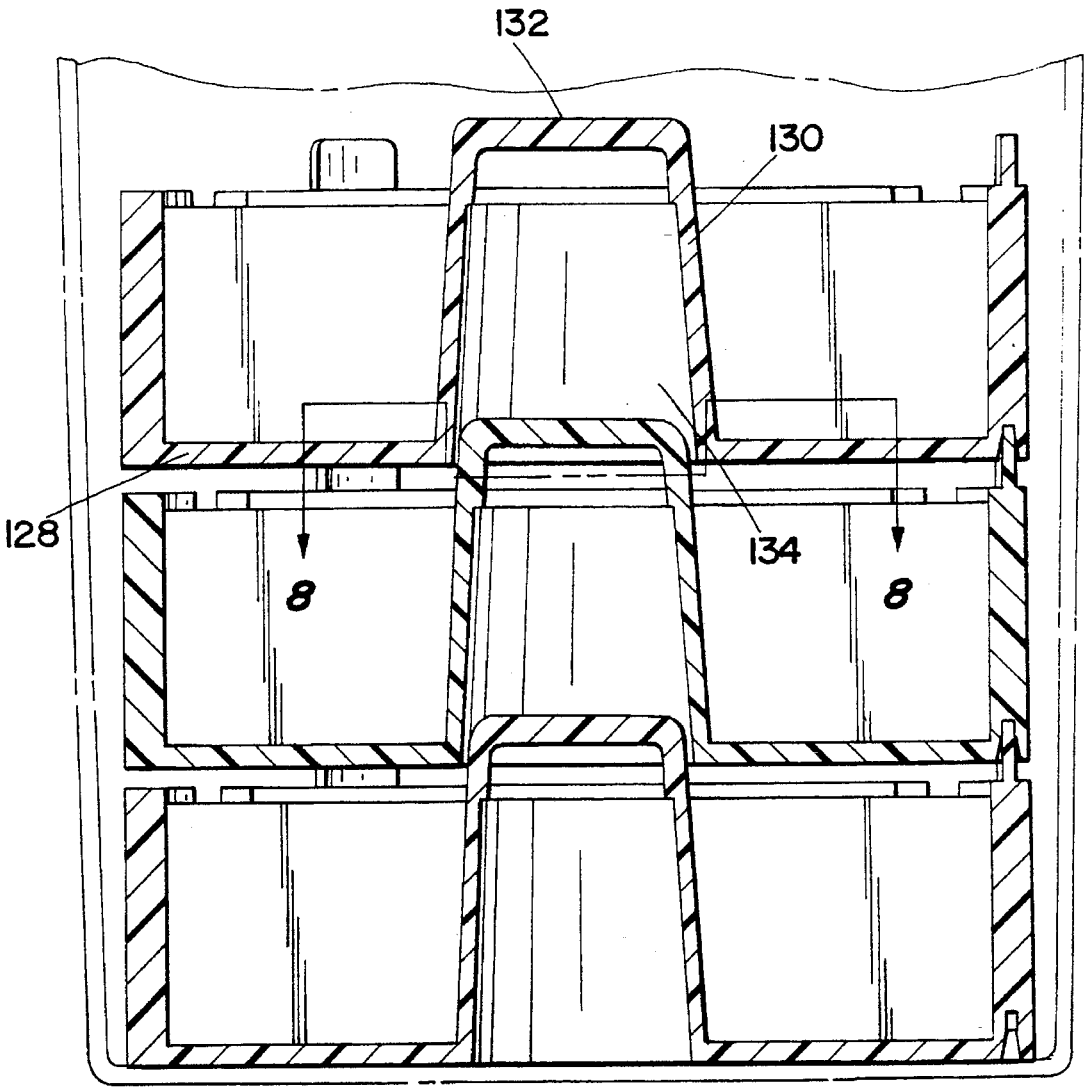
FIG. 7 is a vertical cross-sectional view of a second embodiment of the invention, the view being generally analogous to FIG. 3.
Figure 8:
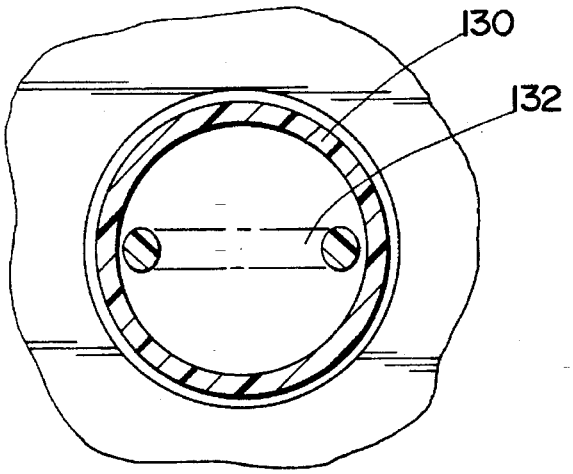
FIG. 8 is a fragmentary view of the second embodiment taken along line 8—8 of FIG. 7 and depicting in particular the hub member and handle.

An alternative embodiment of the invention is depicted in FIGS. 7 and 8. In this version, planar annular tray floor 128 is joined to or formed integrally with frustro-conical hub member 130 around the lower circumference thereof. The hub member has a hollow construction and terminates at its upper end in inverted U-shaped handle 132. When the trays are stacked, the handle of the inferior tray is received within the interior volume of the hub member. In all other respects, this embodiment is identical in construction to the preferred embodiment above described.

In a third embodiment of the invention, the trays are constructed with a planar, circular tray floor which omits the concave inner region incorporated into the preferred embodiment. In order to prevent interference between the inferior tray handle and the superior tray floor, the height of the tabs disposed on the sidewall rims is increased to provide a vertical spacing between the trays equal to or greater than the height of the handle, thereby permitting the top of the handle to clear the superior tray floor.

It should be noted that the invention as described herein may be packaged for sale in a number of different manners. For example, a kit comprising both the trays and the bucket may be sold together. Such a kit would be particularly attractive to homeowners, who may not have easy access to empty drywall or paint containers. Additionally, the invention may be packaged either in sets of three trays or as individual trays. It should further be noted that the invention may be manufactured out of any suitable material or combination of materials.

While preferred embodiments of the invention have been shown and described, it will be apparent to those skilled in the art that various modifications may be made in these embodiments without departing from the spirit of the present invention. For that reason, the scope of the invention is set forth in the following claims.

What is claimed is:

1. A device for adapting a bucket for use in organizing and carrying hardware or other items, the device comprising a plurality of stackable trays, each of said trays comprising:

a generally planar circular floor member;

a vertical sidewall, said sidewall being substantially perpendicular to and extending upwards from the circumference of said floor member, said sidewall terminating at its upper end in a circular rim;

a generally cylindrical hub member, said hub member being disposed in the center of and extending upwards from said floor member;

a plurality of planar partitions extending radially outward from said hub member to said sidewall, said partitions forming a plurality of separate compartments for storing hardware or other items;

an opposed pair of said partitions being fixedly attached to said sidewall and said hub member;

a handle fixedly attached to said opposed pair of fixed partitions, an upper portion of said handle extending above the plane defined by the upper rim of said sidewall;

a concave recess disposed in the center portion of the underside of said floor member, said recess being of suitable shape and volume to receive said upper portion of said handle, and;

a plurality of planar label-retainer members, said label-retainer members being attached to the inner surface of said sidewall and being disposed proximal to the upper rim of said sidewall, said label-retainer members having a horizontal surface for accepting and holding a label identifying the function of the corresponding compartment;

wherein the handle portion of an inferior tray may be received by the recess disposed in the superior tray, allowing the ways to be stacked within the bucket container.

2. A device according to claim 1, said plurality of trays each further comprising:

a plurality of generally rectangular tabs arranged on and projecting upwards from said rim of said sidewall, and;

a corresponding plurality of slots formed into and within the lower margins of said sidewall, said slots being of sufficient size to receive the upper portions of said tabs arranged on said rim of the inferior tray sidewall.

3. A device according to claim 1, wherein at least one of said partitions is removable.

4. A device according to claim 1, wherein the diameter of said floor member is substantially equal to, but not greater than, the inner diameter of a standard five-gallon bucket container.

5. A device for adapting a bucket for use in organizing and carrying hardware or other items, the device comprising a plurality of interfitting stackable trays, each of said trays comprising:

a generally planar circular floor member;

a vertical sidewall, said sidewall being substantially perpendicular to and extending upwards from the circumference of said floor member, said sidewall terminating at its upper end in a circular rim;

an upwardly-tapering hollow hub member of frustroconical shape, said hub member being disposed in the center of and extending upwards from said floor member and terminating at its distal end in a handle for manually grasping and lifting said tray, said handle being fixedly attached to said hub member, the interior of said hub member defining a receptacle for receiving said handle of an inferior tray;

a plurality of planar partitions extending radially outward from said hub member to said sidewall, the partitions forming a plurality of separate compartments for storing hardware or other items, said compartments being further defined by the surfaces of said floor member, said sidewall and said hub member;

said rim of said sidewall of an inferior tray engaging said floor member of the superior tray when the trays are placed in stacked arrangement, and;

a plurality of planar label-retainer members, said label-retainer members being attached to the inner surface of said sidewall and being disposed proximal to the upper rim of said sidewall, said label-retainer members having a horizontal surface for accepting and holding a label identifying the function of the corresponding compartment;

wherein the handle portion of an inferior tray may be received by the interior volume of the hub member of the superior tray, thereby allowing the trays to be stacked within the bucket container.

6. A device according to claim 5, said plurality of trays each further comprising:

a plurality of generally rectangular tabs arranged on and projecting upwards from said rim of said sidewall, and;

a corresponding plurality of slots formed into and within the lower margins of said sidewall, said slots being of sufficient size to receive the upper portions of said tabs arranged on said rim of the inferior tray sidewall.

7. A device according to claim 5, wherein at least one of said partitions is removable.

8. A device according to claim 5, wherein the diameter of said floor member is substantially equal to, but not greater than, the inner diameter of a standard five-gallon bucket container.

* * * * *